US005604397A

United States Patent [19]

Mizohata et al.

[11] Patent Number: 5,604,397

[45] Date of Patent: Feb. 18, 1997

[54] IMPROVED TERMINAL LEAD STRUCTURE FOR A FLOURESCENT DISPLAY DEVICE

[75] Inventors: Tadashi Mizohata; Masashi Suzuki, both of Mobara, Japan

[73] Assignee: Futaba Denshi Kogyo K.K., Mobara, Japan

[21] Appl. No.: 364,929

[22] Filed: Dec. 28, 1994

[30] Foreign Application Priority Data

Dec. 28, 1993 [JP] Japan ..... 5-070427

[51] Int. Cl.[6] ..... H01J 1/00

[52] U.S. Cl. ..... 313/495; 313/496; 313/497

[58] Field of Search ..... 313/51, 495, 496, 313/497

[56] References Cited

U.S. PATENT DOCUMENTS

| | | | |
|---|---|---|---|
| 4,259,613 | 3/1981 | DuBois | 313/497 |
| 4,661,743 | 4/1987 | Matsuoka et al. | 313/497 |
| 4,710,765 | 12/1987 | Ohkoshi et al. | 313/497 |

*Primary Examiner*—Nimeshkumar Patel

*Attorney, Agent, or Firm*—Oblon, Spivak, McClelland, Maier & Neustadt, P. C.

[57] ABSTRACT

A fluorescent display device having a control electrode of an internal fixing structure is disclosed. The fluorescent display device include a substrate on which anode terminals and cathode terminals are alternately arranged in a row along an outer peripheral edge of the substrate whereby the display area of the fluorescent display device relative to the substrate can be increased.

1 Claim, 2 Drawing Sheets

IMPROVED TERMINAL LEAD STRUCTURE FOR A FLOURESCENT DISPLAY DEVICE

BACKGROUND OF THE INVENTION

The present invention relates to a fluorescent display device of an internal fixing structure in which leads of a control electrode are directly connected to the control electrode terminals provided on a substrate.

A fluorescent display device generally comprises a phosphor coated anode functioning as a display pattern, a cathode for emitting electrons and a control electrode for accelerating and controlling the electrons emitted from the cathode. These electrodes are held in a high vacuum envelope, As a structure for providing the electrodes in the envelope, there is known an internal fixing structure in the art. As shown in FIG. 2, this structure includes terminals 101 provided on a substrate 100 as a part of the envelope, a control electrode 102, and leads 103 provided on an outer periphery of the control electrode 102 and connected to the terminal 101. The leads 103 are connected and fixed to the terminals 101 by a conductive adhesive agent. The control electrode 102 is fixed to the substrate 100 spaced apart from the substrate 100 by means of the leads 103 so that the control electrode may be arranged above a display area 104 of the substrate 100. The leads 103 serve as a spacer for locating the control electrode 102 at a position spaced by a predetermined distance from the substrate 100. The leads 103 also serve as a lead wire to apply control voltage to the control electrode 102 through the terminals 101. In the outer peripheral edge of the substrate 100, anode terminals 105 are arranged in parallel at a regular interval to which lead-in wires 106 are connected and led out of the vacuum envelope.

In the conventional fluorescent display device of an internal fixing structure, the terminals 101 for the control electrode 102 and the leads 103 for the terminals 101 and the control electrode 102 are arranged in the inside of the substrate 100 where the anode terminals 105 are arranged. The display area 104 is located in a further inner area thereof. Thus, a distance L from the outer periphery of the substrate 100 on the side of the lead-in wires 106 to the outer periphery of the display area 104 is long and that the area of the display area 104 is small relative to that of the substrate 100.

For example, In case where the dimension of the substrate is 40 mm×100 mm, and the thickness of a side plate mounted on the outer periphery of the substrate is 2.35 mm, the distance n is 6.5 mm. This means that the dimension of the display area is 27 mm×72 mm, and the display area is only 48.6% of the dimension of the substrate.

SUMMARY OF THE INVENTION

The present invention has been made in view of the foregoing disadvantage of the prior art.

Accordingly, it is an object of the present invention to provide a fluorescent display device having a control electrode of an internal fixing structure which is capable of increasing display area of the fluorescent display device.

In accordance with the present invention, there is provided a fluorescent display device which comprises a vacuum envelope having a substrate anodes formed on the substrate, a control electrode and a cathode; control electrode terminals provided on the substrate; leads for connecting the control electrode terminals to the control electrode; anode terminals provided on the substrate; and lead-in wires passing through the vacuum envelope and connected to the anode terminals; wherein the control electrode terminals and the anode terminals are alternately arranged in a row along an outer peripheral edge of the substrate.

BRIEF DESCRIPTION OF THE DRAWINGS

These and other objects and many of the attendant advantages of the present invention will be readily appreciated as the same becomes better understood by reference to the following description when considered in connection with the accompanying drawings; wherein.

DETAILED DESCRIPTION OF THE PREFERRED EMBODIMENTS

Figure 1:
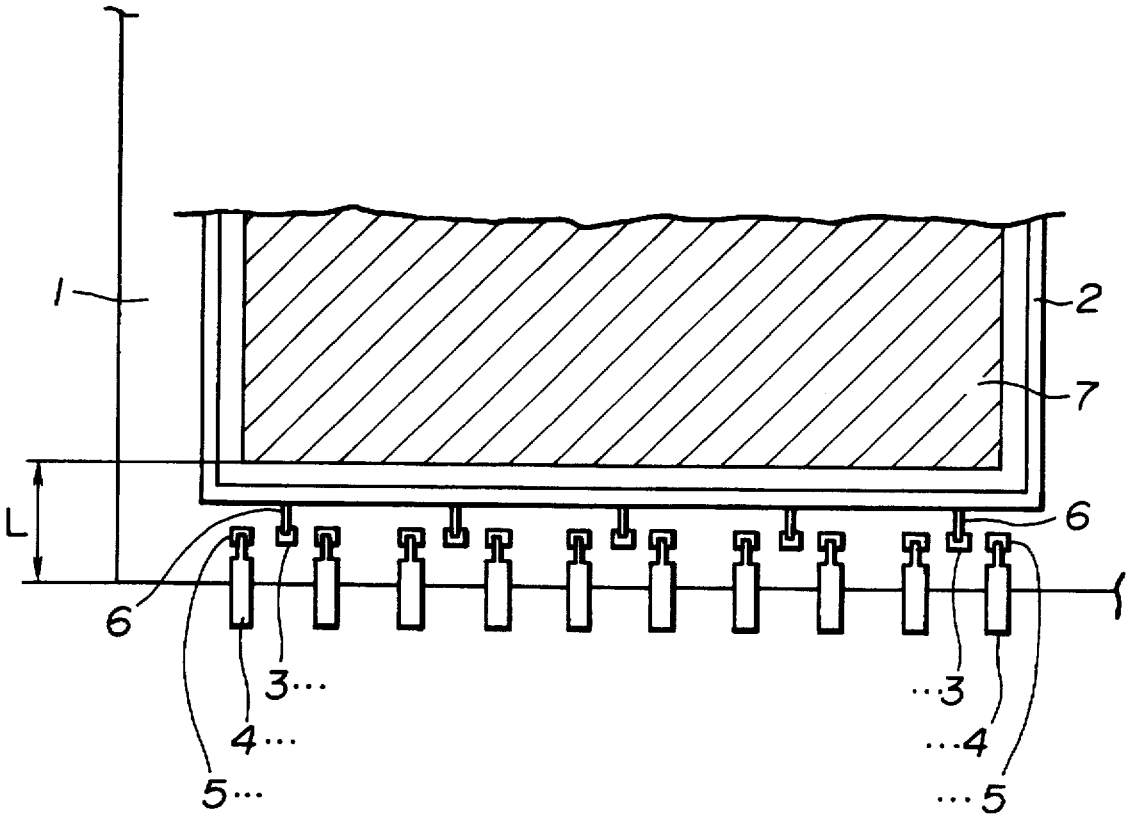
FIG. 1 is a partly enlarged plan view of a substrate in a fluorescent display device of the present invention.
Figure 2:
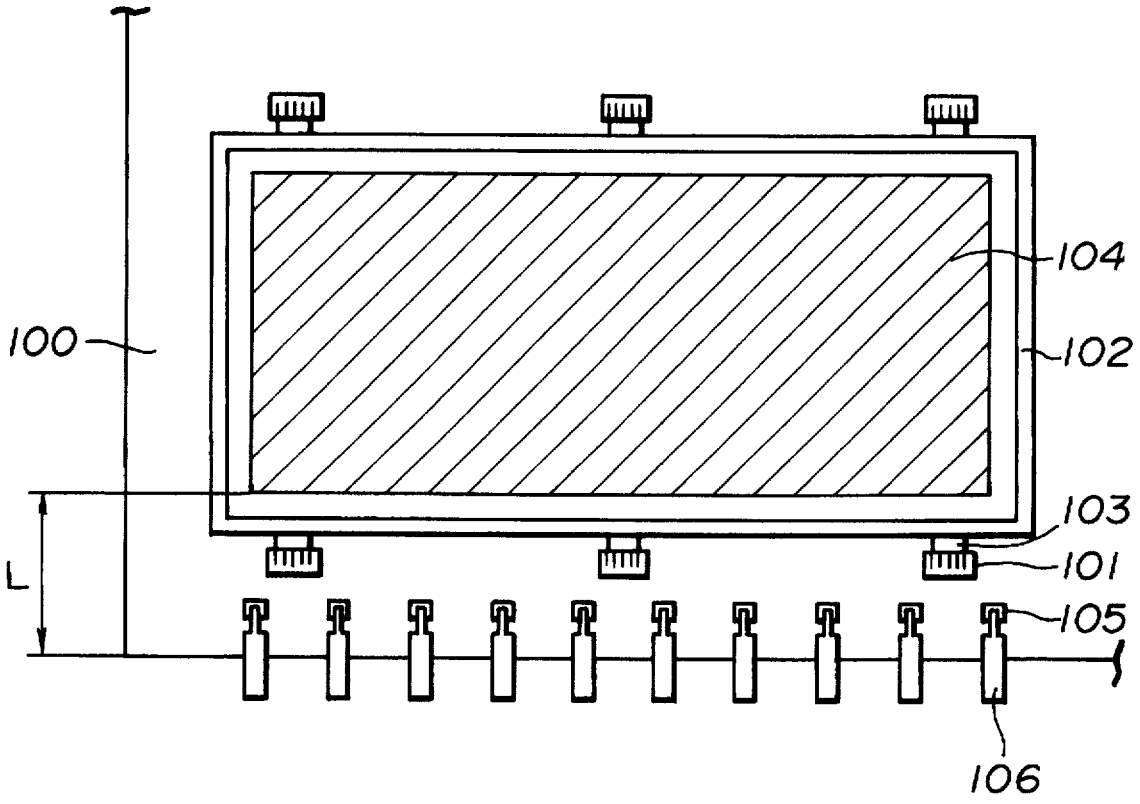
FIG. 2 is partly enlarged plan view of a substrate in a conventional fluorescent display device.

An embodiment of the present invention will now be described with reference to FIG. 1. FIG. 1 shows a substrate 1 on which control electrode terminals 3 and anode terminals 5 for connecting lead-in wires 4 are arranged at a predetermined interval. The anode terminals 5 and the lead-in wires 4 are arranged in the same pitch as in the conventional fluorescent display device. As shown in FIG. 1, at least two control electrode terminals 3 are arranged between the row of the anode terminals 5 and connected to leads 6 for control electrode 2. The pitches for arranging the lead-in wires 4 can be adjusted depending upon the number of the lead 6 of the control electrode 3.

Figure 3:
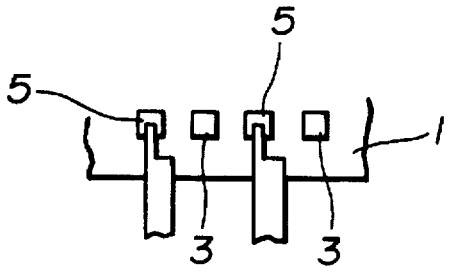
FIG. 3 is a partial plan view of an alternative form of a lead used in the fluorescent display device of the present invention.

According to the fluorescent display device of an internal fixing structure of the present invention, the anode terminals 5 to which the lead-in wires 4 are connected and the control electrode terminals 3 to which the leads 6 for the control electrode 2 are internally fixed are provided in a row or line on the substrate 1. A display area 7 is provided next to the row of the electrode terminals. Thus, a distance L from the outer periphery of the substrate 1 on the side of the lead-in wires 4 to the outer periphery of the display area 7 is shorter than that in the conventional fluorescent display device. As a result, the display area 7 on the substrate 1 can be increased. In the fluorescent display device of the present invention where the dimension of the substrate is 40 mm×100 mm and the thickness of a side plate mounted on the outer periphery of the substrate is 2.35 mm, the distance L becomes 4.7 mm and the dimension of the display area is 30.6 mm×72 mm. The display area is 55.08% of the overall dimension of the substrate. In the fluorescent display device of the present invention, the terminals 3 and 5 are formed smaller in size while maintaining the same pitch between the terminals as that of the conventional fluorescent display device so as to prevent insulation failure between the terminals resulted from decreased in distance between the terminals. As shown in FIG. 3, the lead-in wire may be formed in the shape of prong at the terminating end thereof and the remaining part of the lead-in wire may be the same width as that of the conventional fluorescent display device.

According to the present invention, the anode terminals and the control electrode terminals are alternately arranged along the outer peripheral edge of the substrate, and the display area is arranged next to the row of the electrode terminals. Thus, the outer peripheral edge of the display area can be located adjacent to the outer peripheral edge of the substrate as compared with the conventional fluorescent display device. As a result, the display area relative to the overall dimension of the substrate can be increased.

While preferred embodiments of the invention have been described with a certain degree of particularity with reference to the drawings, obvious modifications and variations are possible in light of the above teachings. It is therefore to be understood that the within the scope of the appended claims, the invention may be practiced otherwise than as specifically described.

What is claimed is:

1. A fluorescent display device comprising:

a vacuum envelope having a substrate with anodes formed on said substrate, a control electrode and a cathode;

control electrode terminals provided on said substrate;

leads for connecting said control electrode terminals to said control electrode;

anode terminals provided on said substrate; and lead-in wires passing through said vacuum envelope and connected to said anode terminals;

wherein said control electrode terminals and said anode terminals are alternately arranged to form a single row along an outer peripheral edge of said substrate.

* * * * *